United States Patent [19]

Behling

[11] Patent Number: 4,932,446

[45] Date of Patent: Jun. 12, 1990

[54] COAXIAL PRESSURE FILL FITTING AND STANDPIPE DRAIN

[75] Inventor: David S. Behling, Caledonia, Ill.

[73] Assignee: Sundstrand Corporation, Rockford, Ill.

[21] Appl. No.: 261,998

[22] Filed: Oct. 25, 1988

[51] Int. Cl.[5] ..... B65B 3/04

[52] U.S. Cl. ..... 141/293; 141/285; 141/292; 141/326; 138/89.4; 137/588

[58] Field of Search ..... 141/285, 289, 291, 292, 141/293, 294, 348, 347, 325, 326, 367, 368; 138/89.4; 137/588; 220/85 F

[56] References Cited

U.S. PATENT DOCUMENTS

| | | | |
|---|---|---|---|
| 3,485,266 | 12/1969 | Sieghartner | 137/588 |
| 3,513,887 | 5/1970 | Limandri | 141/293 |
| 3,842,870 | 10/1974 | Burgess | 141/326 |
| 4,114,058 | 9/1978 | Albaric | 310/54 |
| 4,331,185 | 5/1982 | Rinaldo et al. | 141/326 |
| 4,341,093 | 7/1982 | Oishi et al. | 62/505 |
| 4,364,241 | 12/1982 | Okamoto et al. | 62/508 |
| 4,429,924 | 2/1984 | Franz et al. | 308/187 |
| 4,481,977 | 11/1984 | Maldavs | 141/326 |
| 4,514,652 | 4/1985 | Olson | 310/54 |
| 4,589,524 | 5/1986 | Laycock | 184/103.1 |
| 4,610,284 | 9/1986 | Bartholomew | 137/588 |
| 4,647,805 | 3/1987 | Flygare et al. | 310/61 |
| 4,722,463 | 2/1988 | Anderson | 137/588 |
| 4,763,683 | 8/1988 | Carmack | 141/285 |

FOREIGN PATENT DOCUMENTS

| | | | |
|---|---|---|---|
| 648780 | 9/1962 | Canada | 137/588 |
| 726036 | 10/1942 | Fed. Rep. of Germany | 184/103 |
| 244945 | 12/1925 | United Kingdom | 184/103 R |

*Primary Examiner*—Henry J. Recla
*Assistant Examiner*—Edward C. Donovan
*Attorney, Agent, or Firm*—Antonelli, Terry, Stout & Kraus

[57] ABSTRACT

Pressure filling of an elevated liquid reservoir from a blind servicing location is successfully accomplished by a gravity drain extending from a reservoir vent overfill to the servicing location. A dust cap serves to cover the pressure fill hardware fitting and to provide a primary seal for the drain. A second drain seal is closed by engine operating pressure and opened by application of the pressure fill hardware fitting.

11 Claims, 2 Drawing Sheets

COAXIAL PRESSURE FILL FITTING AND STANDPIPE DRAIN

This invention relates to replenishment of liquid in the reservoir of equipment, such as an engine, having a pressurized lubrication system, and more particularly to the venting of excess liquid from the reservoir to prevent overfill.

BACKGROUND ART

The problem of monitoring liquid level in a reservoir has been addressed by prior art including Laycock U.S. Pat. No. 4,589,524. During pressure filling of the reservoir, the service operator frequently cannot see the reservoir because of the size of the equipment and the location of the reservoir. As overfilling as well as underfilling of the reservoir can be damaging, it is desirable for the service operator, while at a position remote from the reservoir, to be able to detect a properly filled condition and quickly discontinue the filling operation to prevent excessive overflow.

DISCLOSURE OF INVENTION

An object of the present invention is to provide a adapter to which pressurized fill liquid is applied and which also contains a gravity drain from an overflow vent in the reservoir that signals the service operator when the reservoir is full.

Another object is to combine into a unitary housing a pressure fill adapter and overflow port which provides single point servicing and thereby simplifies maintenance of a vehicle such as an aircraft.

In a preferred embodiment, a dust cover which must be removed to provide access to the fill opening is configured to also seal off the gravity drain thereby allowing the service operator to prevent leakage once the overflow has terminated. A second back-up seal in the gravity drain is provided in the housing which is closed by operation of the engine and opened by application of the fitting on the pressure fill equipment.

To open the first seal, the dust cover is removed. To open the second seal, a poppet stem engaged by the conventional pressurized oil fill equipment displaces the seal element for the drain line in the housing. The replenishment procedure cannot be started without having both drain seals opened. The secondary seal is closed in response to pressure created during engine operation to provide a back-up seal in the event the dust cap seal fails.

It is a further object to provide a novel body, nut and transfer tubular member assembly wherein the transfer member is axially slidable in a first direction by application of the conventional pressure fill nozzle to the housing and in the reverse direction by engine operating pressure. The nut may contain a central bore for ducting pressure fill liquid to the reservoir and a plurality of peripheral passageways for ducting the overfill liquid to the ambient near the position of the fill service operator at the aperture of the housing.

These and other objects of the invention will become more fully apparent from the claims and from the description as it proceeds in connection with the drawings.

BEST MODE FOR CARRYING OUT THE INVENTION

Figure 1:
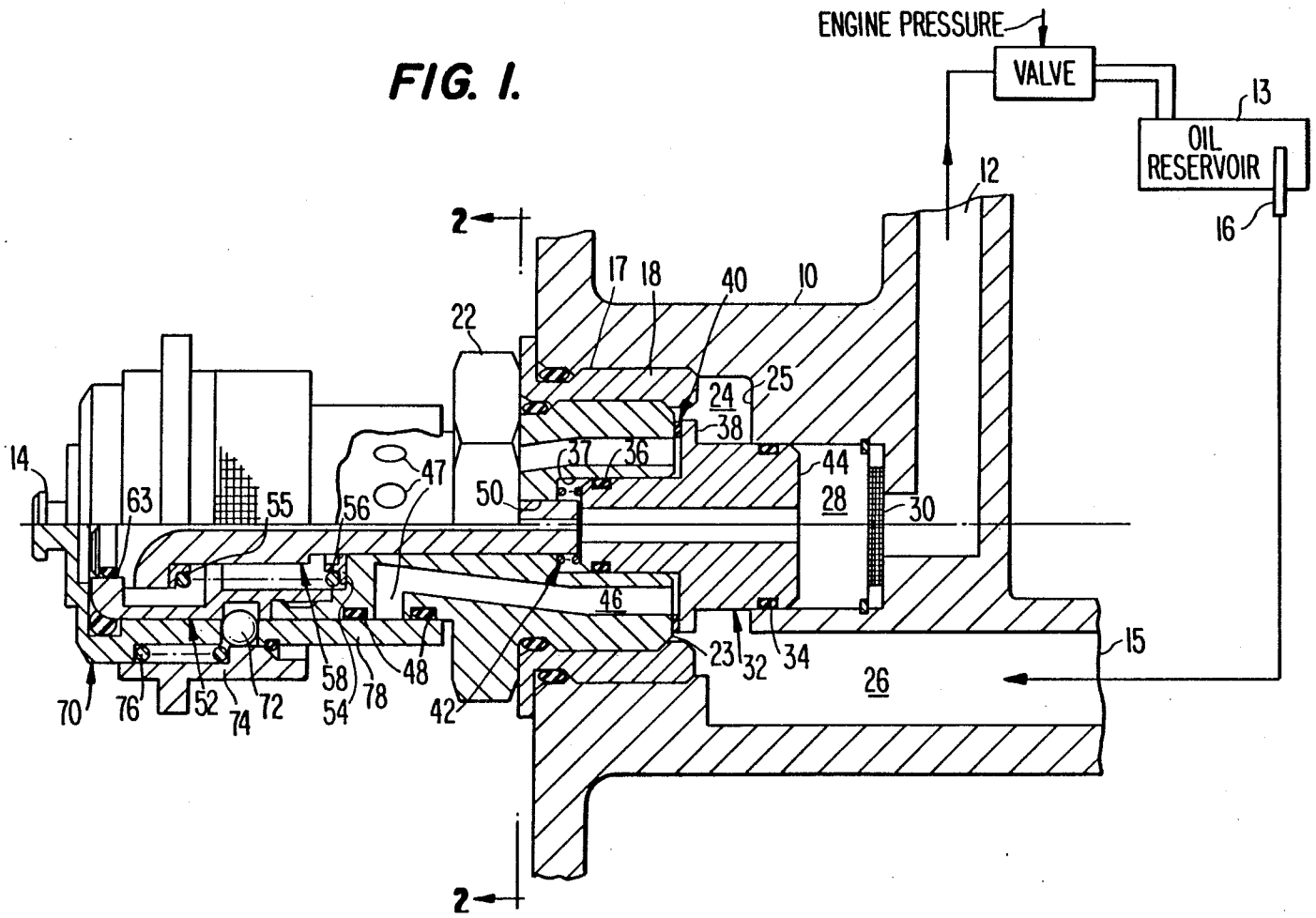
FIG. 1 is a schematic of the lubrication filling system with an assembly drawing in partial section showing the fitting and drain according to the present invention.

The filler according to the present invention includes a main body 10 which has a liquid outlet 12 through which hydraulic liquid such as oil is supplied to a reservoir 13 of equipment such as to a constant speed drive mechanism, an integrated drive generator or the like.

The liquid is applied through a fitting at 14, which is part of pressure fill adapter and normally protected by a dust cover 70 all as described below, shown at the left side of FIG. 1 that is accessed by the maintenance person with a servicing connector of a device for pumping such liquid under pressure. The body 10 further has an overflow fluid passage 15 that is connected to a standpipe drain pipe or vent 16 that captures excess liquid once the equipment crankcase is properly filled and allows the overflow from pipe 16 to drain by gravity to the ground level at the position of the maintenance person who is adding the liquid.

On a side of the housing 10 opposite overflow passage 15 is a bore having a threaded portion 17 that receives a bushing 18 which in turn receives a novel nut 22 that has an end face 23. A chamber 24 is provided between nut end face 23 and wall 25 located at a central interior portion of housing 10. Passageway 26 connects passage 15 and chamber 24.

Beyond wall 25 in body 10 is a cylindrical chamber 28 having a diameter smaller than the diameter of chamber 24. Chamber 28 is hydraulically connected to the liquid outlet 12 through a duct arrangement including screen 30.

A transfer tubular body 32 has a generally cylindrical shape and includes an outer wall and a sealing O-ring 34 which is mounted for sliding movement along the walls of chamber 28. A small diameter O-ring 36 is positioned at the other end of transfer tubular body 32 and is slidably received in a bore 37 in face 23 of nut 22. A flange 38 is centrally located on transfer tube 32 and carries a circular drain seal 40 that is adapted to abut in sealing relation against face 23 of nut 22 and serve as a first normally closed valve that is opened during the filling operation.

A transfer tubular member compression spring 42 is positioned between the end faces of the bore 37 and transfer tube 32 near O-ring 36. After filling and before the equipment is operating, sealing ring 40 which serves as a drain seal is maintained at a non-illustrated position spaced from face 23 of nut 22; during engine operation, pressure acting on face 44 of the transfer tubular member 32 is sufficient to overcome the force of transfer tube spring 42 and the force due to the same pressure acting on the relatively small area at opposite end face of transfer tubular member 32 thereby holding sealing ring 40 in its illustrated sealing position against face 23 of nut 22.

Figure 2:
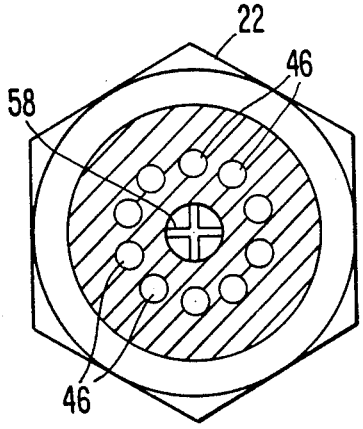
FIG. 2 is a section taken along line 2—2 of FIG. 1.

Nut 22 is formed with a plurality of passageways 46, the number illustrated in FIG. 2 being ten. Passageways 46 extend from face 23 along the length of nut 22 and are angled to provide exit openings 47 which are positioned around the outer peripheral surface of a central body portion of nut 22. Peripheral grooves are axially spaced on opposite sides of openings 47 to retain O-ring sealing members 48 which serve as a primary seal for the overflow drain oil received at passage 15 of the body 10 from a standpipe 16.

Nut 22 has a central through aperture having a cylindrical wall 50 and an axis which is coaxial with the axis of the corresponding through aperture in transfer tubular member 32. Together, the central through apertures serve as part of the ducting for the liquid to be added to the reservoir when the engine is not operating.

Nut 22 additionally has an end section which is secured to a pressure fill adapter 52 of known construction. The end face 54 on nut 22 abuts against a compression spring 56. Compression spring 56 is part of the pressure fill adapter and poppet member 58 construction.

Figure 3:
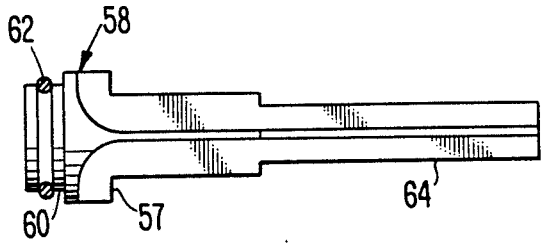
FIG. 3 is an elevation of the poppet member.

The opposite end 55 of compression spring 56 has a retainer which engages a surface 57 on poppet member 58 shown also in FIG. 3. Poppet member 58 has a cylindrical end 60 that accepts the service connector and is displaceable against the force of spring 56 to unseal the O-ring 62 from the abutting surface 63 of the pressure fill adapter 52.

As best shown in FIG. 3, poppet member 58 has a longitudinally extending stem 64 which may have a cross section in the form of a cross as shown best in FIG. 2. When the servicing connector is attached, a central probe engages the free end of poppet member 58 and forces the stem in a direction to compress spring 56. The stem 64 then forces the transfer tubular member 32 in a direction toward screen 30 and thereby removes the drain seal 40 from its engagement with the face 23 of nut 22. O-ring 62 on the left side of the poppet member 58 is also displaced to thereby provide a hydraulic duct from the servicing connector through to the pressure fill outlet 12 on body 10 and to the oil reservoir 13.

When the pressure fill servicing connector is removed, a dust cap 70 fits over the pressure fill adapter 52 and has a cylindrical body that supports a plurality of balls 72 which engage surfaces on the adapter to retain the dust cap 70 in its illustrated position. Movement of a surrounding sleeve 74 against the force of compression spring 76 places a ramp in alignment with balls 72 to allow the dust cap 70 to be readily removed all is conventional.

Dust cap 70 is provided with a novel skirt extension 78 that slides over both sealing O-rings 48 that are spaced axially along on nut 22 to be on opposite sides of the passageway openings 47. The skirt extension 78 tightly engages O-rings 48 to provide a primary seal for preventing liquid leakage during operation of the equipment.

The servicing connector structure is not shown because it is conventional and is substantially identical to the dust cap 70 construction insofar as its attachment to the pressure fill adapter is concerned except that no part reaches to either of the O-rings 48.

In operation when liquid is being added by the servicing personnel, leakage occurring through passageway openings 47 indicates that overflow is occurring at standpipe 16. This overflow oil flows from passage 15 axially toward the left in FIG. 1 until reaching the radial portions of the passageway openings 47 where the oil can exit from the fitting. When this oil is seen by the service operator, the service operator turns off the flow of oil into the equipment and removes the servicing connector from the fitting.

Removal of the service connector allows spring 56 to retract poppet stem 64 back to its illustrated position. Transfer tube spring 42 maintains the transfer tubular member 32 away from the base of the stem 64 which keeps the secondary drain seal 40 open to allow overflow hydraulic fluid to drain from passageway openings 47.

After waiting for the oil overflow to drain from passageway openings 47, the operator replaces the dust cap 70 into its sealing position as shown in FIG. 1. A secondary seal is provided when the equipment is operated by engine fluid pressure transmitted through fluid outlet 12 through screen 30 to surface 44 of the transfer tubular member. The force due to this pressure assures the creation of a secondary seal by the engagement of sealing ring 40 with face 23 of nut 22. The secondary seal serves as assurance against leakage in the event the primary seal provided by dust cover 70 is not effective due to loss or failure to be properly installed.

The physical contact between the poppet stem 64 and transfer tubular member 32, which forces the transfer tubular member toward the right as viewed in FIG. 1, ensures that pressure developed in the oil-out circuit during pressure filling will not hydraulically close the secondary standpipe drain seal at sealing ring 40 and inadvertently allow overfilling.

While only a single embodiment has been described, other variations and modifications which fall within the scope of the appended claims are intended to be covered thereby.

What is claimed:

1. Apparatus including a liquid reservoir having an overflow vent comprising a body having:

a liquid outlet connected to said reservoir for supplying replenishing liquid thereto;

a liquid drain inlet adapted for connection to the overflow vent in said reservoir to receive overflow liquid from said overflow vent and a passageway from said drain inlet to an outlet opening through a first normally closed valve;

a pressure fill liquid inlet means located adjacent said outlet opening and including a second normally closed valve to permit liquid to be pressure filled into said reservoir through said liquid outlet when adding liquid to said reservoir;

means mounted for axial sliding movement actuated by a service connector for opening said second normally closed valve at said pressure fill inlet and for concomitantly opening said first normally closed valve for draining liquid received at said liquid drain inlet from said vent, said liquid drainage being along a path parallel to the axis of said sliding means to said outlet opening to prevent overfilling; and means including a unitary dust cap configured to seal said outlet opening against liquid leakage and to close said pressure fill liquid inlet means.

2. Apparatus as defined in claim 1 wherein said sliding means includes a transfer tubular member and a poppet member comprising a stem that is spring biased away from said transfer tubular member both mounted for axial sliding movement, said transfer tubular member having a centrally located flange, a sealing ring secured to said flange for providing a first seal to block liquid flow from said vent to the exterior of said body.

3. Apparatus for filling a liquid reservoir having an overflow vent comprising a body having:

a liquid outlet connected to said reservoir for supplying replenishing liquid thereto;

a liquid drain inlet adapted for connection to the overflow vent in said reservoir to receive overflow liquid from said overflow vent and a passageway from said drain inlet to an outlet opening through a first normally closed valve;

a pressure fill liquid inlet means including a second normally closed valve to permit liquid to be pressure filled into said reservoir through said liquid outlet when adding liquid to said reservoir;

means mounted for axial sliding movement actuated by a service connector for opening said second normally closed valve at said pressure fill inlet and for concomitantly opening said first normally closed valve for draining liquid received at said liquid drain inlet from said vent to prevent overfilling, said sliding means including a transfer tubular member and a poppet member comprising a stem that is spring biased away from said transfer tubular member both mounted for axial sliding movement, said transfer tubular member having a centrally located flange, a sealing ring secured to said flange for providing a first seal to block liquid flow from said vent to the exterior of said body;

wherein said poppet stem has an end which extends outwardly away from said transfer tubular member and has channel means for conveying said liquid from said service connector through said transfer tubular member and to said liquid outlet; and a dust cover member mounted over a support which houses said outwardly extending end of said poppet stem and cooperates with a seal means for providing a second seal in series with said first seal to block liquid flow in a path from said vent to the exterior of said body.

4. Apparatus for filling a liquid reservoir having an overflow vent comprising a body having:

a liquid outlet connected to said reservoir for supplying replenishing liquid thereto;

a liquid drain inlet adapted for connection to the overflow vent in said reservoir to receive overflow liquid from said overflow vent and a passageway from said drain inlet to an outlet opening through a first normally closed valve;

a pressure fill liquid inlet means including a second normally closed valve to permit liquid to be pressure filled into said reservoir through said liquid outlet when adding liquid to said reservoir;

means mounted for axial sliding movement actuated by a service connector for opening said second normally closed valve at said pressure fill inlet and for concomitantly opening said first normally closed valve for draining liquid received at said liquid drain inlet from said vent to prevent overfilling;

a nut threadedly received in said body and having a through aperture for slidably receiving a portion of said axial sliding means;

means hydraulically connecting said through aperture to the normally closed inlet for transporting replenishment liquid; and said nut further having a plurality of normally sealed passageways surrounding said through aperture and disposed to be connected, while adding liquid to said device, to receive hydraulic fluid from said vent and to duct said fluid to the exterior of said body at a position near the service connector.

5. Apparatus for filing a liquid reservoir having an overflow vent comprising a body having:

a liquid outlet connected to said reservoir for supplying replenishing liquid thereto;

a liquid drain inlet adapted for connection to the overflow vent in said reservoir to receive overflow liquid from said overflow vent in said reservoir and a passageway from said drain inlet to an outlet opening through a first normally closed valve;

a pressure fill liquid means including a second normally closed valve to permit liquid to be pressure filled into said reservoir through said liquid outlet when adding liquid to said reservoir;

means mounted for axial sliding movement actuated by a service connector for opening said second normally closed valve at said pressure fill inlet and for concomitantly opening said first normally closed valve for draining liquid received at said liquid drain inlet from said vent to prevent overfilling;

a nut threadedly received in said body and having a central through aperture for slidably receiving a portion of said axial sliding means, said nut further having a plurality of passageways which extend from said normally closed valve that is positioned inside said body and along a path terminating in openings which are located around the periphery of said nut exteriorly of said body;

a pair of sealing O-rings mounted around the periphery of said nut to be on axially spaced opposite sides of said last mentioned passageway openings; and a dust cover member having a cylindrical inner surface fitted over a portion of said nut and engaging said pair of sealing O-rings to form a seal to prevent liquid leakage from said passageway openings.

6. Apparatus as defined in claim 5 wherein said first normally closed valve comprises a first surface on said nut facing a flange movable with said axially slidable means, a sealing ring supported on said flange to engage said first surface along a line which circumscribes all the passageway openings.

7. Apparatus as defined in claim 6 wherein said axial sliding means includes a transfer tubular member having one end portion mounted in the through aperture of said nut and the other end portion mounted in said body; and wherein said flange is mounted to surround said transfer tubular member between end portions of said transfer tubular member and to be located between the first surface of said nut and an internal facing surface of said body in the drain liquid passageway.

8. Apparatus as defined in claim 7 further including a transfer tubular member spring positioned between a second surface of said nut and said one tubular member end portion for urging the flange sealing ring away from said nut first surface, the area of the wall of said transfer tubular member facing said nut second surface being smaller than the area of the wall at the other end of said transfer tubular member whereby operating pressure applied to said transfer tubular member produces a differential force which is opposite to and greater than the force of the transfer tubular member spring for urging said sealing ring against the first surface of said nut.

9. In combination with an apparatus having a pressurized liquid system which requires the addition of liquid to a reservoir through a fitting that is subjected to device operational pressure, said reservoir having a separate overflow vent through which replenishment liquid passes to prevent overfilling:

a body member having a first bore adapted to be connected at one end to said reservoir via an exit duct and having a threaded wall section at another end;

a nut having a threaded portion at one end which is threadedly received at said threaded wall section, a central through aperture axially aligned with said first bore and a plurality of fluid drain passageways surrounding said central aperture, the passageways near the threaded end portion opening onto a face of said nut and having centers that are disposed about said central through aperture, the passageways at an opposite end of said nut opening outwardly in a radial direction;

said body member having a second bore adapted to be connected to said vent and opening into an enlarged central interior region of the body that is in fluid communication with said first bore and the passageways at the face of said nut;

a transfer tubular member having a first end slidably mounted in said first bore, a second end slidably mounted in the central through aperture of said nut and a central through bore in fluid communication with said exit duct, said transfer tubular member further including a flange supporting a sealing means which engages said nut face radially outwardly of said passageway openings to isolate hydraulically said passageways from said enlarged region; and means for displacing said transfer tubular member to a position where said sealing means is separated from said nut face during pressure filling of said reservoir to allow overflow liquid to drain radially outwardly from said passageways.

10. The combination as defined in claim 9 wherein said transfer member displacing means includes a poppet comprising a stem having one end positioned adjacent an end of said transfer tubular member and mounted for sliding movement along an axis located centrally of said passageways;

a dust cover member positioned over a stem end of said poppet that is opposite said one end and having a skirt extending over a portion of said nut where the passageways open outwardly in a radial direction; and a pair of sealing rings carried by said nut which engage said cover member on axially spaced opposite sides of said passageway openings to serve as a seal against leakage of liquid from said vent.

11. Apparatus for replenishing the supply of liquid in a reservoir from a location beneath the reservoir which includes a reservoir having an overflow pipe and a housing comprising:

a first inlet for admitting liquid received under pressure from a servicing supply;

a first inlet for admitting liquid received under pressure from a servicing supply;

an outlet connected to the first inlet for conducting said liquid to said reservoir with the overflow pipe positioned to prevent overfill of the reservoir;

a second inlet connected to receive overflow liquid from said overflow pipe;

channel means extending through an interior location of a chamber in said housing and having first and second ends, said first end having openings to the ambient at a location adjacent said first inlet, said second end opening into said chamber and;

means for conducting overflow liquid from said second inlet to said channel means at said interior location;

said apparatus further including a dust cap for sealing said openings against leakage and for closing said first inlet.

* * * * *